US006116457A

United States Patent [19]

Haberman

[11] Patent Number: 6,116,457

[45] **Date of Patent: *Sep. 12, 2000**

[54] DRINKS CONTAINERS

[76] Inventor: Mandy Nicola Haberman, 44 Watford Road, Radlett, Hertfordshire, United Kingdom, WD7 8LR

[ * ] Notice: This patent issued on a continued prosecution application filed under 37 CFR 1.53(d), and is subject to the twenty year patent term provisions of 35 U.S.C. 154(a)(2).

[21] Appl. No.: 08/817,821

[22] PCT Filed: Sep. 2, 1996

[86] PCT No.: PCT/GB96/02154

§ 371 Date: Jul. 7, 1997

§ 102(e) Date: Jul. 7, 1997

[87] PCT Pub. No.: WO97/08979

PCT Pub. Date: Mar. 13, 1997

[30] Foreign Application Priority Data

| | | | |
|---|---|---|---|
| Sep. 1, 1995 | [GB] | United Kingdom | 9517931 |
| Mar. 15, 1996 | [GB] | United Kingdom | 9605436 |
| May 30, 1996 | [GB] | United Kingdom | 9611233 |

[51] Int. Cl.[7] ..... A47G 19/00

[52] U.S. Cl. ..... 220/703; 220/714

[58] Field of Search ..... 220/703, 714, 220/717

[56] References Cited

U.S. PATENT DOCUMENTS

| | | |
|---|---|---|
| 4,138 | 8/1845 | Pratt . |
| D. 359,417 | 6/1995 | Chen . |
| 1,122,868 | 12/1914 | Davis . |
| 1,206,661 | 11/1916 | Booth . |
| 1,825,553 | 9/1931 | Smith . |
| 1,989,714 | 2/1935 | Statham . |
| 2,174,361 | 9/1939 | Condon . |
| 2,175,052 | 10/1939 | Bull et al. . |
| 2,223,179 | 11/1940 | Longheed . |
| 2,534,614 | 12/1950 | Michael . |
| 2,544,464 | 3/1951 | Matthews et al. . |

(List continued on next page.)

FOREIGN PATENT DOCUMENTS

| | | |
|---|---|---|
| 0 160 336 | 11/1985 | European Pat. Off. . |
| 0 278 125 B1 | 8/1988 | European Pat. Off. . |
| 0 326 743 A2 | 8/1989 | European Pat. Off. . |
| 0 382 631 A1 | 8/1990 | European Pat. Off. . |
| 0 384 394 A2 | 8/1990 | European Pat. Off. . |
| 0 395 380 A3 | 10/1990 | European Pat. Off. . |
| 0 555 623 | 8/1993 | European Pat. Off. . |
| 996.998 | 12/1951 | France . |
| 1364891A | 10/1964 | France . |
| 2128875 | 12/1972 | Germany . |
| 26 09 310 | 9/1976 | Germany . |
| 31 18976 A1 | 12/1982 | Germany . |
| 3941668 A1 | 4/1991 | Germany . |
| 145824 | 2/1961 | Russian Federation . |
| 1 046 518 | 10/1966 | United Kingdom . |
| 1 253 398 | 11/1971 | United Kingdom . |
| 2 015 350 | 9/1979 | United Kingdom . |
| 2 015 350 | 12/1979 | United Kingdom . |
| 2 098 958 | 12/1982 | United Kingdom . |
| 2 131 301 | 6/1984 | United Kingdom . |
| 2 169 210 | 7/1986 | United Kingdom . |
| 2 226 014 | 6/1990 | United Kingdom . |
| 2 266 045 | 10/1993 | United Kingdom . |
| 2 279 130 | 12/1994 | United Kingdom . |
| WO 93/19718 | 10/1993 | WIPO . |
| WO 94/04023 | 3/1994 | WIPO . |

OTHER PUBLICATIONS

Purfect Ideas from Tommee Tippee, Chemist & Druggist, Aug. 15, 1992.

Publication referring to NUK teats pp. 19–15, 20–21.

*Primary Examiner*—Steven Pollard

*Attorney, Agent, or Firm*—Wallenstein & Wagner, Ltd.

[57] ABSTRACT

A lid (1) for a drinks container has a mouthpiece (6) provided with a valve (2) which comprises a membrane (7) of resiliently flexible material formed generally at its center with at least one slit or other piercing (8) which is normally sealed. The membrane (7) is dished inwardly of the mouthpiece, but when suction is applied, it is caused to invert to allow liquid to be drawn through its slit(s) (8). The valve (2) may instead be provided in the top of a drinks carton or in the end of a drinking straw.

7 Claims, 1 Drawing Sheet

U.S. PATENT DOCUMENTS 2,569,139 9/1951 Abelson .
2,608,841 9/1952 Rice .
2,623,524 12/1952 Clemens .
2,628,616 2/1953 Ransom .
2,646,670 7/1953 Spalding et al. .
2,758,755 8/1956 Schafler .
2,816,548 12/1957 Tupper .
2,989,961 6/1961 Blanchett .
3,085,710 4/1963 McIlroy .
3,139,064 6/1964 Harle .
3,241,726 3/1966 Chester .
3,342,379 9/1967 Foley .
3,372,832 3/1968 Yeater et al. .
3,393,817 7/1968 Meierhoefer .
3,424,157 1/1969 Paolo .
3,438,527 4/1969 Gamblin .
3,445,042 5/1969 Elmore et al. .
3,490,488 1/1970 Grist .
3,635,380 1/1972 Fitzgerald .
3,650,271 3/1972 Pelli .
3,669,323 6/1972 Harker et al. .
3,718,140 2/1973 Yamauchi .
3,797,696 3/1974 Dibrell ..... 220/714
3,905,512 9/1975 Albert et al. .
3,915,331 10/1975 Chenault .
3,921,630 11/1975 McPhee .
3,964,631 6/1976 Albert .
4,002,168 1/1977 Petterson .
4,057,177 11/1977 Laauwe .
4,088,166 5/1978 Miller .
4,133,457 1/1979 Klassen .
4,135,513 1/1979 Arisland .
4,138,033 2/1979 Payne et al. .
4,139,124 2/1979 Ferrante .
4,166,553 9/1979 Fraterrigo .
4,238,045 12/1980 D'Andria .
4,245,752 1/1981 Prueher .
4,303,170 12/1981 Panicci .
4,314,658 2/1982 Laauwe .
4,340,054 7/1982 Michaels .
4,350,260 9/1982 Prueher .
4,356,935 11/1982 Kamin .
4,361,249 11/1982 Tuneski et al. .
4,434,810 3/1984 Atkinson .
4,441,623 4/1984 Antoniak .
4,441,624 4/1984 Sokolowski .
4,463,859 8/1984 Greene .
4,470,523 9/1984 Spector .
4,519,530 5/1985 Schmidt .
4,582,214 4/1986 Dart et al. .
4,607,755 8/1986 Andreozzi .
4,616,768 10/1986 Flier .
4,646,945 3/1987 Steiner et al. .
4,660,747 4/1987 Borg et al. .
4,728,006 3/1988 Drobish et al. .
4,747,519 5/1988 Green et al. .
4,749,108 6/1988 Dornsbusch et al. .
4,756,440 7/1988 Gartner .
4,779,766 10/1988 Kinsley .
4,782,975 11/1988 Coy .
4,795,063 1/1989 Sekiguchi et al. .
4,796,774 1/1989 Nabinger .
4,828,141 5/1989 Coy ..... 220/714 X
4,836,404 6/1989 Coy ..... 220/714
4,865,207 9/1989 Joyner et al. .
4,909,416 3/1990 Evezich .
4,921,112 5/1990 Juhlin et al. .
4,928,861 5/1990 Schiemann .
4,941,598 7/1990 Lambelet, Jr. et al. .
4,946,062 8/1990 Coy .
4,953,737 9/1990 Meyers .
4,987,740 1/1991 Coleman .
4,991,745 2/1991 Brown .
4,993,568 2/1991 Morfuji et al. .
5,005,737 4/1991 Rohr .
5,033,647 7/1991 Smith et al. .
5,033,655 7/1991 Brown .
5,035,340 7/1991 Timmons .
5,040,756 8/1991 Via Cava .
5,050,758 9/1991 Freeman et al. .
5,060,811 10/1991 Fox .
5,071,017 12/1991 Stull .
5,072,842 12/1991 White .
5,079,013 1/1992 Belanger .
5,101,991 4/1992 Monifuji et al. .
5,115,950 5/1992 Rohr .
5,147,066 9/1992 Snider ..... 220/703 X
5,186,347 2/1993 Freeman et al. .
5,203,470 4/1993 Brown .
5,213,236 5/1993 Brown et al. .
5,339,995 8/1994 Brown et al. .
5,377,877 1/1995 Brown et al. .
5,542,670 8/1996 Morano .

DRINKS CONTAINERS

This invention relates to drinks containers or vessels, including drinking vessels suitable for use as a trainer cup or the like.

Traditionally, trainer cups (that is, a cup or mug provided with a lid having a mouthpiece associated therewith, usually in the form of a spout) have been used by young children to bridge the gap between use of a baby's feeding bottle and use of a normal cup or glass. The trainer cup is often the child's first step in learning to feed itself. The provision of a lid with a spout is intended to make it easier for the child to feed itself, because it can locate the spout in its mouth in much the same manner as it could previously locate a teat of a feeding bottle in its mouth. However, young children of this age are naturally exuberant. Eating becomes a noisy and messy experience. The trainer cup is often shaken violently or knocked over. In either event, with a traditional trainer cup, this results in spillage. For travel purposes, a separate closure disc needs to be fitted to the cup underneath the lid, or the lid is required to have an adjustable closure arrangement.

My UK patent application No. 2 266 045 described a number of drinking vessels which were suitable for use as a trainer cup or cup for the elderly or infirm. Such drinking vessels comprised an open-mouthed, generally cup-shaped container and a lid for covering the open mouth of the container. The lid had an associated mouthpiece. Valving was provided to prevent flow of liquid from the interior of the container through the mouthpiece unless a predetermined level of suction was applied to the mouthpiece, and such that a user could draw liquid through the mouthpiece by the sole application of suction to the mouthpiece. The arrangements have proved successful in overcoming the problem of spillage, but are of relatively complicated and expensive construction.

In accordance with the present invention, there is provided an article through which or from which a drinking liquid is taken by a consumer, the article being provided with a valve which comprises a membrane of resiliently flexible material which is dished inwardly of the article, opposite the direction through which the drinking liquid is taken in use of the article, said membrane being formed generally at its centre with at least one slit or piercing.

In the normal condition of the valve, the orifice provided by the slit(s) or piercing is closed, i.e. the material of the membrane closes up under its own resilience. Also, if there is moderate internal pressure acting outwardly on the valve, e.g. the weight of the contents of a container or vessel bearing down on the valve when the container or vessel is inverted, then this pressure helps to urge the material of the membrane, on opposite sides of the slit(s) or piercing, to close together.

However, the valve opens to allow the free flow of liquid through the valve if suction is applied e.g. by the mouth. For example, the valve may be provided in a projecting mouthpiece of a container or lid for the container: then if the mouthpiece is inserted into the user's mouth and the user applies suction, this causes the flexible membrane to invert and the slit(s) or piercing to open and so allow the free flow of liquid. The valve may be incorporated in the top of a drinks carton: either suction can be applied as described above for drinking directly from the carton, or the carton can be squeezed to increase its internal pressure and expel the liquid through the valve, to pour the liquid into a separate vessel. In all cases however, a drinking straw may instead be pushed through the orifice in the valve, and the user may then drink through this straw.

When suction is applied, the dished membrane is caused to invert and allow liquid to be drawn through its orifice, then when the suction is released, air passes through the orifice into the container, to equalise or nearly equalise the pressures either side of the valve: further, the valve assumes its normal condition (i.e. dished inwardly) under its own resilience.

Slit valves have been proposed in the past, but in general, such slit valves have been dished or domed in the direction of the flow. So far as I am aware, it has never previously been proposed to provide slit valves dished in the direction opposite to the flow direction of the liquid which they control or, more particularly, a slit valve dished in the direction contrary to the flow of liquid which it is designed to control and which also allows flow of air in the opposite direction to the liquid flow.

In a preferred arrangement, the valve membrane is co-moulded with the container, or lid for a container, internally thereof. In the case of a lid having a mouthpiece, these are preferably formed in a single piece with a circumextending skirt at the lower end of the lid, enabling the lit to be fitted within the open mouth of a cup-shaped container, a radial circumextending ridge serving to limit entry of the skirt into the open mouth.

In a further embodiment, the valve may be incorporated into the end of a drinking straw. In this case, the straw may be inserted into a conventional carton, piercing its usual foil membrane but then forming a relatively effective seal: the valve in the straw then provides for use of the combination in the manner described above.

Embodiments of the present invention will now be described by way of examples only and with reference to the accompanying drawings, in which.

Figure 1:
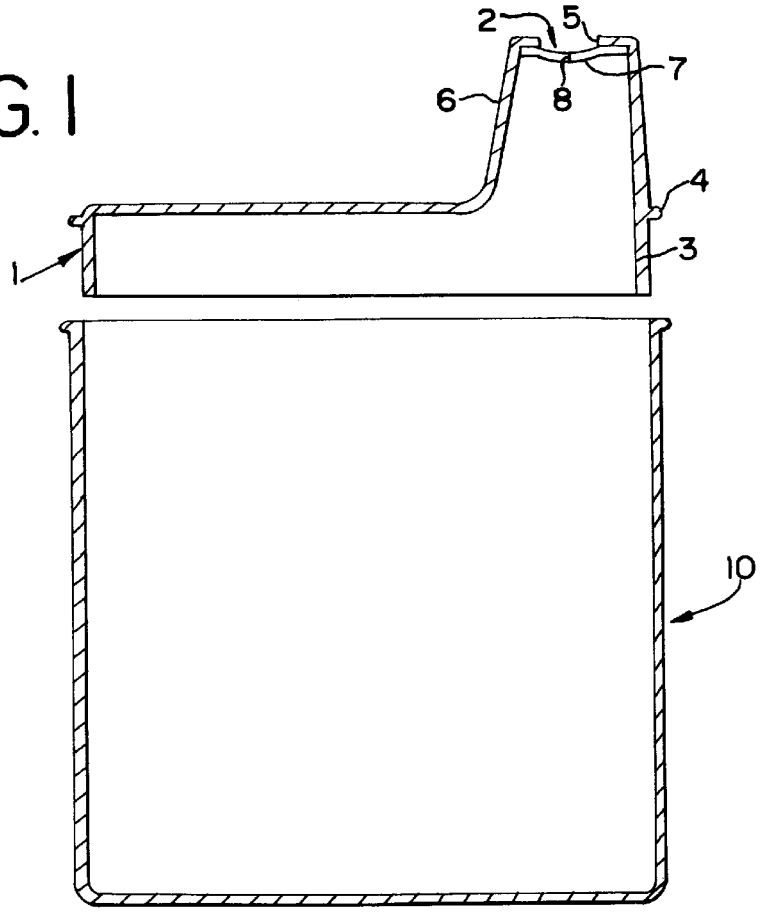
FIG. 1 is a section through the lid for a drinking vessel.

Referring to the drawings, there is shown a lid 1 for use on an open-top cup-shape container 10 of conventional form. The lid 1 is of a one-piece construction and is co-moulded together with a valve generally indicated at 2. The lid 1 is provided with an integral, peripheral skirt 3 on its lower side, the upper edge of which skirt is bounded by a peripheral ridge 4 which extends radially outwardly. When the lid 1 is fitted to the open-top of its cup-shaped container, the skirt 3 extends downwardly within the cup and the ridge 4 sits on the upper peripheral edge of the cup. This provides an adequate seal to prevent spillage. The only opening in the lid 1, other than that bounded by the skirt 3, is an opening 5 in an upwardly-projecting mouthpiece 6. The general shape of the mouthpiece 6 may be similar to that of traditional trainer cups. The difference lies in the provision of the valve 2. Valve 2 is formed from a resiliently flexible sheet or disc 7, which may be of rubber or more preferably of plastics material, and has one or more slits 8. A single slit may suffice; a preferred arrangement employs a pair of slits which intersect to form a cross-cut. The or each slit is literally a slit or division rather than an open slot so that in the natural condition of the valve, in which the sheet 7 forming the valve is dished slightly inwardly of the mouthpiece, the or each slit 8 is fully closed thereby preventing egress of liquid from the interior of the vessel or ingress of air from outside the vessel. An orifice may be provided in the disc 7, instead of the slit or slits 8, by piercing the disc with a pointed implement: in all cases, the slit or other orifice is formed by severing through the disc without removing any material thereof.

The material of the lid 1, apart from the flexible valve sheet 7, is suitable made of a relatively hard plastics material such as polycarbonate or polypropylene. The material of the valve sheet 7 is selected so that it can readily be co-moulded with the mouthpiece. If the flexible sheet is formed of a similar plastics material to the remainder of the lid 1, such co-moulding is facilitated. This can be achieved by making the sheet 7 significantly thinner so as to give is enhanced flexibility as compared with the remainder of the lid, or by producing it in a similar plastics but with a greater amount of plasticizer. In the case of the thermohardening plastics material, the material of the remainder of the lid can be partially cured before the material for the flexible sheet is added to the mould and then the cure continued for a further period so as to harden the lid but only partially harden the material of the sheet 7. Alternatively, the sheet 7 can be formed as a separate piece and of a plastics material which does not harden with heat and may be inserted into the mould with material for forming the remainder of the lid, the remainder of the lid being formed of thermohardening material so that curing hardens the remainder of the lid and integrates the valve sheet into the mouthpiece. In a preferred arrangement, the remainder of the lid is formed of polypropylene and is pre-formed in the mould. The material for the sheet 7 is then added into the mould in the required region as a liquid and is then cured. The preferred material for the sheet 7 is a block co-polymer sold under the Trade Mark EVOPRENE which comprises a styrene-ethylene-butylene-styrene copolymer.

Other arrangements will readily occur to those skilled in the plastics moulding arts.

With the arrangement described and illustrated, there is no leakage through the orifice 8, in the natural unbiased condition of the valve; if a predetermined suction is applied to the mouthpiece, the flexible sheet 7 will be drawn upwardly, opening the orifice 8 and allowing liquid to the drawn out. Release of the suction will allow air to pass backwardly through the same orifice 8 until the valve returns to its original condition in which position the valve will again be closed. Under the influence of normal internal pressure, for example if the container is inverted, this pressure will tend to urge together material of the sheet 7 either side of its orifice 8, and so close the orifice.

Figure 2:
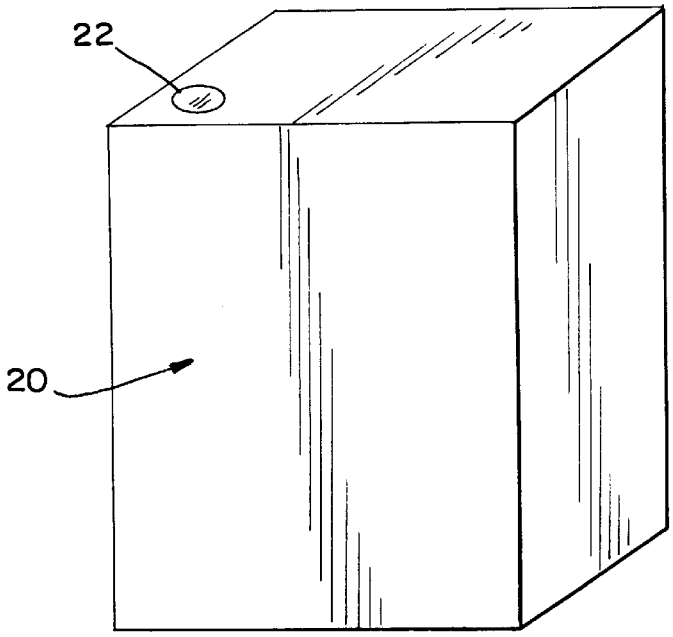
FIG. 2 is a schematic view of a drinks carton.

Although use of the valve has been described hereinabove with a view to its incorporation in a particular article of manufacture, namely the lid of a trainer cup or cup for the elderly and infirm, the valve is of much wider utility. The valve may in particular be incorporated into the top of a drinks carton 20, as shown in FIG. 2. In such case, the user may drink from the carton 20 by offering the valved portion of the carton to the mouth and applying suction, or by inserting a drinking straw through the orifice in the valve 22. In either case, liquid can be expelled from the carton by squeezing the carton to increase its internal pressure. In a further embodiment (not shown), the valve may be incorporated into the end of a drinking straw: the straw can then be inserted into a conventional carton, piercing its usual foil membrane but then forming a relatively effective seal; the valve in the straw then provides for use of the combination in the same manner as described above with reference to the drawing.

What is claimed is:

1. An article through which or from which a drinking liquid is taken by a consumer, the article having a spout provided with a valve comprising a membrane of resiliently flexible material, said membrane being provided with at least one split adapted such that the liquid may be drawn from or through said article by the sole application of a predetermined level of suction in the region of said valve, characterized in that the membrane has a normal condition in which it is dished inwardly of the article, opposite the direction through which the drinking liquid is taken in use of the article and is adapted to close up by returning to the normal inwardly dished condition under its own resilience when such suction is removed.

2. An article as claimed in claim 1 in which said membrane is formed with a pair of said slits which intersect to form a cross-out.

3. An article as claimed in claim 1 in which said membrane is co-moulded with the article.

4. An article as claimed in claim 1, in the form of a drinks container or vessel provided with said valve in its top.

5. An article as claimed in claim 1, in the form of a drinks container or vessel having a mouthpiece provided with said valve.

6. An article as claimed in claim 1, in the form of a lid for a drinks container or vessel, said lid having a mouthpiece provided with said valve.

7. An article as claimed in claim 1, in the form of a drinking straw provided with said valve at one end thereof.

* * * * *

UNITED STATES PATENT AND TRADEMARK OFFICE

CERTIFICATE OF CORRECTION

PATENT NO. : 6,116,457
DATED : September 12, 2000
INVENTOR(S) : Mandy Nicola Haberman It is certified that errors appear in the above-identified patent and that said Letters Patent is hereby corrected as shown below:

Col. 2, Line 21, delete the word "lit" and insert therefor --lid--

Col. 4, Line 20, delete the word "split" and insert therefor --slit--

Col. 4, Line 31, delete the word "cross-out" and insert therefor --cross-cut--

Signed and Sealed this

First Day of May, 2001

*Attest:*

Nicholas P. Godici

NICHOLAS P. GODICI

*Attesting Officer*

*Acting Director of the United States Patent and Trademark Office*